US009327947B2

(12) United States Patent
Davis

(10) Patent No.: US 9,327,947 B2
(45) Date of Patent: May 3, 2016

(54) ALL-TERRAIN VEHICLE LIFTING CRANE APPARATUS

(71) Applicant: Mickel Davis, Indianola, MS (US)

(72) Inventor: Mickel Davis, Indianola, MS (US)

( * ) Notice: Subject to any disclaimer, the term of this patent is extended or adjusted under 35 U.S.C. 154(b) by 0 days.

(21) Appl. No.: 14/083,512

(22) Filed: Nov. 19, 2013

(65) Prior Publication Data

US 2014/0144861 A1 May 29, 2014

Related U.S. Application Data

(60) Provisional application No. 61/729,808, filed on Nov. 26, 2012.

(51) Int. Cl.
*B66C 23/00* (2006.01)
*B66C 23/44* (2006.01)

(52) U.S. Cl.
CPC ..... *B66C 23/44* (2013.01)

(58) Field of Classification Search
CPC ..... B66D 5/02; B66C 23/04; B66C 23/36; B66C 23/38; B66C 23/42; B66C 23/44; B66C 23/68; B66C 23/70
USPC ..... 254/252, 258
See application file for complete search history.

(56) References Cited

U.S. PATENT DOCUMENTS

| | | | | | |
|---|---|---|---|---|---|
| 2,167,026 | A * | 7/1939 | Hatch | 212/248 |
| 2,200,274 | A * | 5/1940 | Hayes | 212/296 |
| 2,446,488 | A * | 8/1948 | Pierce | 414/543 |
| 2,557,484 | A * | 6/1951 | Wagner et al. | 212/280 |
| 3,432,145 | A * | 3/1969 | Mudge | 254/337 |
| 4,069,922 | A | 1/1978 | Hawkins | |
| 4,419,038 | A * | 12/1983 | Pendergraft | 414/543 |
| 4,515,282 | A * | 5/1985 | Falch | 212/271 |
| 4,556,358 | A * | 12/1985 | Harlan | 414/550 |
| 4,671,731 | A * | 6/1987 | Harlan | 414/550 |
| 4,806,063 | A | 2/1989 | York | |
| 5,090,580 | A * | 2/1992 | Nelson | 212/180 |
| 5,211,297 | A * | 5/1993 | Vandervalk | 212/294 |
| 5,662,451 | A | 9/1997 | Muzzi et al. | |
| 5,758,785 | A * | 6/1998 | Spinosa et al. | 212/300 |
| 5,765,809 | A * | 6/1998 | Baker et al. | 254/335 |
| 5,788,095 | A * | 8/1998 | Watson | 212/180 |
| 5,975,831 | A | 11/1999 | Martin | |
| 6,189,866 | B1 * | 2/2001 | Harkins et al. | 254/332 |
| 7,156,246 | B2 | 1/2007 | Sherrod | |
| 7,575,120 | B2 | 8/2009 | Beatty | |
| 2003/0039535 | A1 * | 2/2003 | Gourand | 414/543 |
| 2005/0230340 | A1 * | 10/2005 | Barger et al. | 212/280 |
| 2008/0169258 | A1 * | 7/2008 | Weisbauer | 212/296 |
| 2012/0241403 | A1 * | 9/2012 | Ethington | 212/281 |

* cited by examiner

*Primary Examiner* — Emmanuel M Marcelo
(74) *Attorney, Agent, or Firm* — Daniel Boudwin; Global Intellectual Property Agency LLC

(57) ABSTRACT

An all-terrain vehicle lifting crane apparatus is provided, having a pivotable and telescoping lifting boom and a tethered lifting hook that is powered by hand crank or by electric motor. The apparatus includes a base plate supporting an upstanding post, within which the vertical member of the lifting boom is pivotably supported therein. The lifting boom includes a telescoping structure to allow for extending its length over an article to be lifted. Both the telescoping aspect and the pivotable aspect are securable to lock the apparatus into a static configuration. The device is ideally suited for connection to an all-terrain vehicle and for lifting large game animals onto the vehicle cargo area after a hunt.

3 Claims, 4 Drawing Sheets

ALL-TERRAIN VEHICLE LIFTING CRANE APPARATUS

CROSS REFERENCE TO RELATED APPLICATION

This application claims the benefit of U.S. Provisional Application No. 61/729,808 filed on Nov. 26, 2012, entitled "ATV Crane." The above identified patent application is herein incorporated by reference in its entirety to provide continuity of disclosure.

BACKGROUND OF THE INVENTION

1. Field of the Invention

The present invention relates to all-terrain vehicles and lifting equipment. More specifically, the present invention pertains to a lifting crane in connection with an all-terrain vehicle, whereby the crane is pivotable, extendable, and driven by either a hand crank winch or an electrically powered winch assembly for lifting heavy objects onto the vehicle.

Hunting large game animals is a popular activity for many, where a hunter engages an animal using a bow or rifle for the purposes of killing the animal and thereafter retrieving and taking it out of the field. Many of the large game animals are hunted for food and for trophy purposes, where the animal provides a large quantity of consumable meat and its carcass can be stuffed and preserved for display purposes.

Many individuals travel great distances into the wilderness to reach appropriate hunting grounds. Most utilize a form an automobile, all-terrain vehicle, or motorbike to reach their destination. When hunting larger game, however, the vehicle must be sufficient to carry the hunter and his passengers, their gear, and also allow for the additional cargo weight of any prey animals successfully hunted. Large deer, elk, moose, buffalo, and other wild game are particularly large and would otherwise be impossible to move after the animal is killed without mechanical assistance. Therefore a vehicle equipped to handle the load of the animal is necessary to retrieve the animal and take it out of the field.

While finding a suitable vehicle is not a large task, the act of loading the animal into the vehicle can be a difficult one while in the field, particularly if hunting alone. Large game animals can weigh several hundred pounds, making manual lifting for a single or even team of hunters practically impossible. Lifting such a heavy load, even if possible, is not healthy for the hunter who may not always be traveling with assistance. Pulling a muscle, straining, or throwing one's back out while in the wilderness can be a significant occurrence that could pose a risk to the hunter if unable to easily get home. Therefore, a mechanical assistant device is required that can more readily lift large loads from the field and into a vehicle after a hunting kill, wherein the device does not require significant user input to transfer the animal from the ground and into the vehicle cargo area.

Lifting devices for all-terrain vehicles (ATVs) and vehicles are present in the prior art and generally relate to simple lifting devices positioned in some manner to the vehicle. These devices include singular degrees of freedom or are overly complex for the given task of lifting a large game animal. The present invention contemplates a simple lifting crane that is attachable to an ATV that is capable of lifting loads extended away from the vehicle and around the perimeter of the vehicle, where repositioning of the crane does not require the user to move the vehicle in the process. The device includes a base attachment to the vehicle cargo bed, an extendable and pivotable crane arm, and a hoist driven by either a hand crank winch or electrically powered winch. The device working end secures to a bound game animal, lifts the same, and then is capable of swiveling the animal over the bed of the vehicle for resting the same thereon for transportation away from the hunting grounds.

2. Description of the Prior Art

Devices have been disclosed in the prior art that relate to lifting devices and vehicle lifting cranes. These include devices that have been patented and published in patent application publications. The following is a list of devices deemed most relevant to the present disclosure, which are herein described for the purposes of highlighting and differentiating the unique aspects of the present invention, and further for highlighting the drawbacks existing in the prior art.

Specifically, U.S. Pat. No. 4,806,063 to York discloses a portable game hoist that is mountable to a trailer hitch receiver and includes a boom, a winch, a pulley system, and a torsion bar adapted to bear against the body of the supporting vehicle. The boom secures over an exposed ball hitch and is secured thereagainst by way of tie down straps, while the torsion bar bears against the vehicle as the tensioned straps cinch down the assembly against the vehicle. The York device provides an elongated boom supportable from a tow hitch ball that utilizes straps for securement. The present invention provides a more permanent crane structure that is attached to the vehicle and freely movable therefrom to position the lifting hook over a hunted animal, requiring no additional straps or bearing members for support.

U.S. Pat. No. 7,156,246 to Sherrod discloses a retractable and rotating ATV lift boom that is adapted to be supported from the tubular cargo rack of an ATV. A hand crank winch is utilized to control a lifting line that travels the length of the boom. The device attaches to the ATV using a pair of U-bolts, a base plate, and a piece of angle iron, whereby the assembly secures to the ATV cargo rack for support thereof and of lifted articles. The boom of Sherrod is adapted for connection to an ATV rack, rather than being supported by a base plate.

U.S. Pat. No. 7,575,120 to Beatty discloses an ATV hoist that is secured to the frame of the ATV. The hoist includes a base arm and a sliding arm that allows for extension of the overall hoist, wherefrom a cable and cable hook is suspended. The Beatty device is useful for lifting a load vertically, but fails to provide any further degrees of freedom. Specifically, the Beatty device cannot swivel a load onto the ATV cargo area, but rather can only lift it upwards thereonto.

U.S. Pat. No. 5,975,831 to Martin discloses a game hoist from an ATV cargo rack that includes a base plate, an upstanding column, and a horizontal boom that telescopes outward and supports a hoisted lifting hook. A manually operated embodiment includes a handle to extend and retract the boom, whereby the handle operates the telescoping mechanism and thus the position of the boom working end. The present invention provides a rotatable and extendable boom that can be pin-locked into a desired position, or freely connected to allow for rotating the load around the vehicle and then shifting the load onto the cargo area.

U.S. Pat. No. 5,662,451 to Muzzi discloses hoist for lifting an animal carcass from an ATV, wherein the device comprises a vertical support shaft, a horizontal boom, and a pulley supported cable system for lifting carcasses from the ground. A secondary bracing leg can be deployed for supporting the vertical support shaft, which extends to the ground for lifting heavier loads. The Muzzi device fails to disclose additional degrees of freedom with respect to the lifting apparatus, where the Muzzi device is a rigid structure that is capable of lifting loads vertically only.

The present invention comprises a lifting apparatus that can extend and pivot to manipulate the handled load once connected thereto by way of the lifting cable and hook working end. The apparatus includes a pivotable boom and an upstanding portion secured to the cargo area of the vehicle, while the boom can telescope outwards to position its distal end over the hunted game animal to be lifted. It is submitted that the present invention is substantially divergent in design elements from the prior art, and consequently it is clear that there is a need in the art for an improvement to existing ATV-mounted lifting apparatuses. In this regard the instant invention substantially fulfills these needs.

SUMMARY OF THE INVENTION

In view of the foregoing disadvantages inherent in the known types of ATV lifting cranes now present in the prior art, the present invention provides a new lifting crane apparatus that can be utilized for providing convenience for the user when lifting large game animal and other articles from the ground and onto the vehicle cargo area.

It is therefore an object of the present invention to provide a new and improved ATV lifting crane apparatus that has all of the advantages of the prior art and none of the disadvantages.

It is another object of the present invention to provide an ATV lifting crane apparatus that includes a telescoping and pivotable boom to allow for secure lifting directly over the load and for maneuvering the load once lifted from the ground.

Another object of the present invention is to provide an ATV lifting crane apparatus that includes a lifting hook, cable, and hoist mechanism that is driven by hand crank or by electric motor operation.

Yet another object of the present invention is to provide an ATV lifting crane apparatus that is securable to a vehicle using a flat base plate and fasteners, wherein the base plate supports and upstanding post within which the vertical portion of the lifting boom is pivotably inserted.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
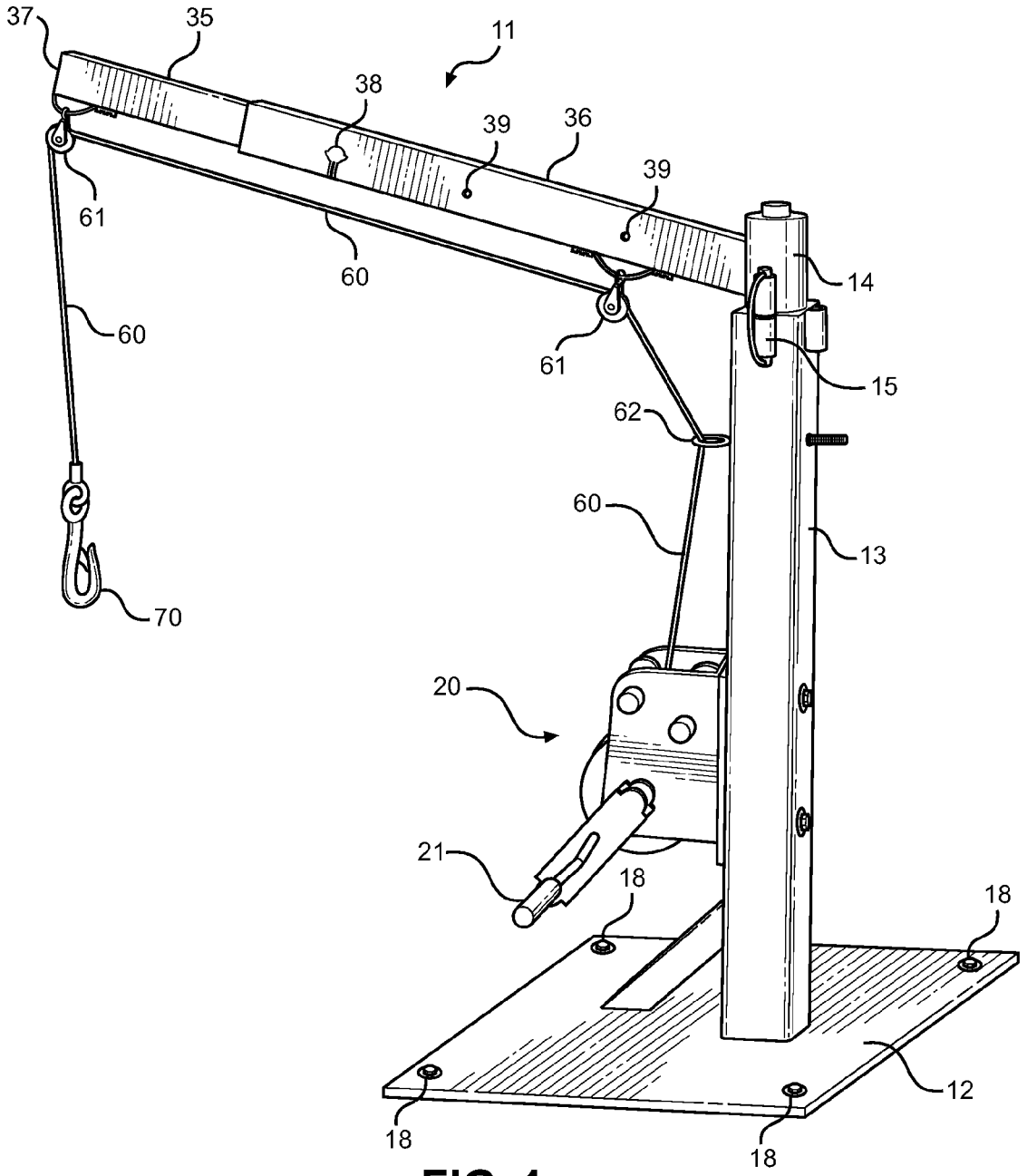
FIG. 1 shows a perspective view of an exemplary embodiment of the present lifting crane apparatus, wherein the device is hand crank driven.

Reference is made herein to the attached drawings. Like reference numerals are used throughout the drawings to depict like or similar elements of the AT lifting crane apparatus. For the purposes of presenting a brief and clear description of the present invention, the preferred embodiment will be discussed as used for lifting large game animals and other loads onto a cargo area of a vehicle using a tethered hook, whereby the load can be lifted onto the vehicle using mechanical assistance and thereafter transported away. The figures are intended for representative purposes only and should not be considered to be limiting in any respect.

Referring now to FIG. 1, there is shown a perspective view of the ATV lifting crane apparatus of the present invention in a hand-driven configuration. The apparatus comprises a base plate 12 supporting an upstanding and hollow post 13. The post 13 receives thereinto the vertical member 14 of the lifting boom 11, which includes a boom arm having two telescoping segments 35, 36 that extend away from the post 13 to position the boom arm distal end 37 over an article to be lifted. The lifting boom 11 is extendable by way of its telescoping structure and is rotatable about its pivotable connection with the upstanding post 13. This allows the user to position a lifting hook 70 suspended by a lifting cable 60 over a game animal or other article to be lifted by the apparatus.

Figure 2:
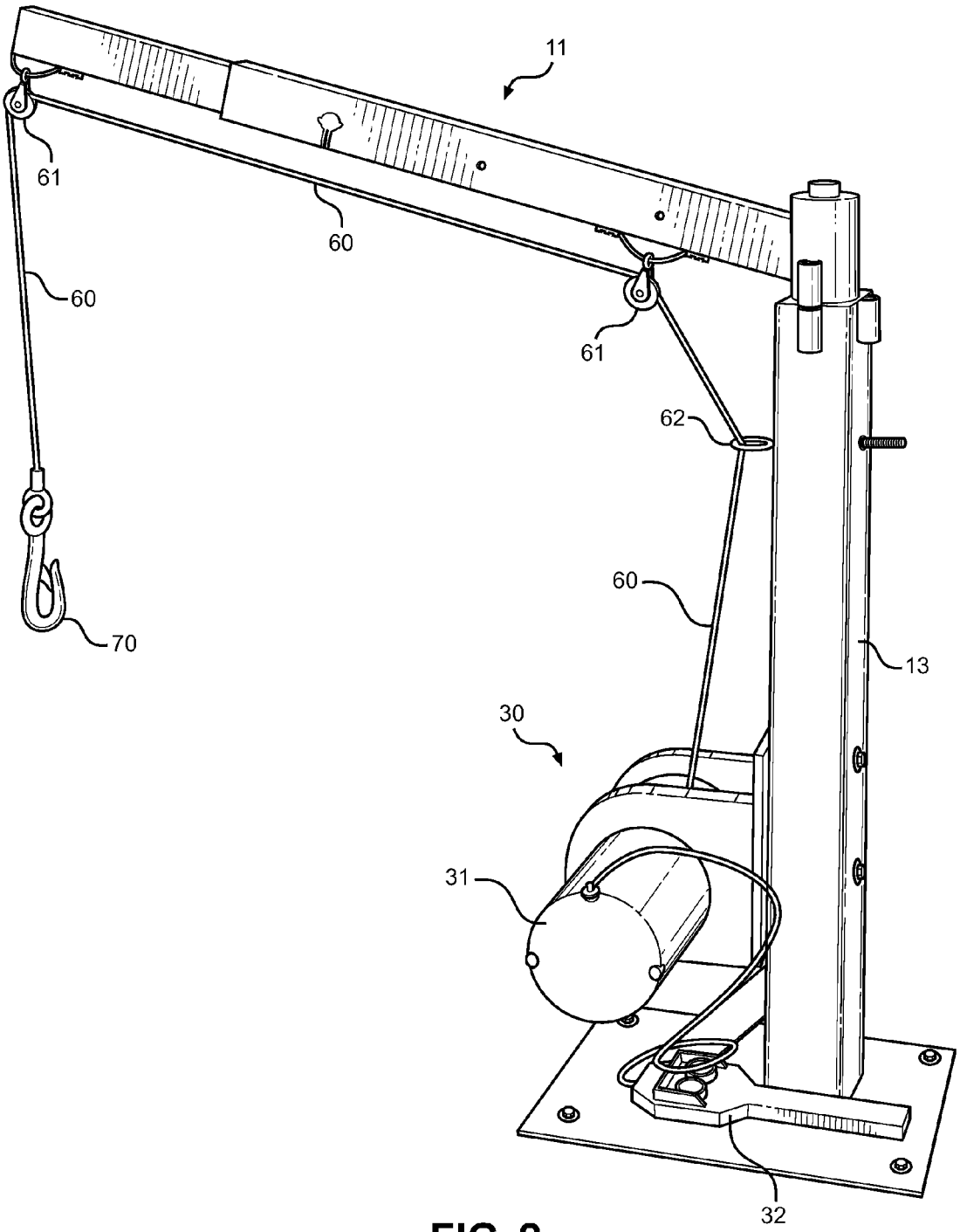
FIG. 2 shows a perspective view of the powered embodiment of the present lifting crane apparatus, wherein the device is driven by an electric motor.

Mounted along the upstanding post 13 is a hoist crank means 20, which can be manually driven (FIG. 1) or electrically driven (FIG. 2). The manually driven embodiment contemplates a hand crank 21 and spool that winds and unwinds a cable 60 attached to a lifting hook 70. The cable is supported along the length of the post 13 and lifting boom 11 by way of pulleys 61 and eyelet guides 62 that guide the cable 60 therealong and ensure the two do not become separated or entangled. The user can therefore position the distal end 37 of the boom 11 over a hunted animal, lower the lifting hook 70 to the ground and secure the hook around the animal or to rope utilized to bind the animal. When positioning the boom 11, it can be rotated about its connection to the upstanding post 13 and extended by way of its telescoping structure. A pin-lock 38 and a series of pin-locking locations 39 are utilized to secure the boom length in a static configuration, while a vertical pin lock 15 locks the boom vertical member 14 to the upstanding post 13 to prevent free rotation thereof.

The apparatus is ideally suited for use by an all-terrain vehicle or a pick-up truck, where each vehicle has a flat cargo area upon which the base plate 12 can be secured. A series of fasteners 18 or similar connection means secure the base plate 12 to the vehicle and maintain the position of the upstanding post when maneuvering the boom 11 and while lifting a load onto the vehicle.

Referring now to FIG. 2, there is shown a powered embodiment of the ATV lifting crane apparatus of the present invention. In this embodiment, the hand-driven crank is replaced by an electrically powered winch 30, which includes an electric motor 31 and spool for controlling the position of the lifting hook 70 during operation. A controller 32 provides an interface for which the user to operate the winch 30 using electrical inputs. As with the hand-driven embodiment, the apparatus includes a pivotable and extendable lifting boom 11 and upstanding post 13, while the cable 60 is secured therealong by way of pulleys 61 and eyelet guide 62 supports.

Figure 3:
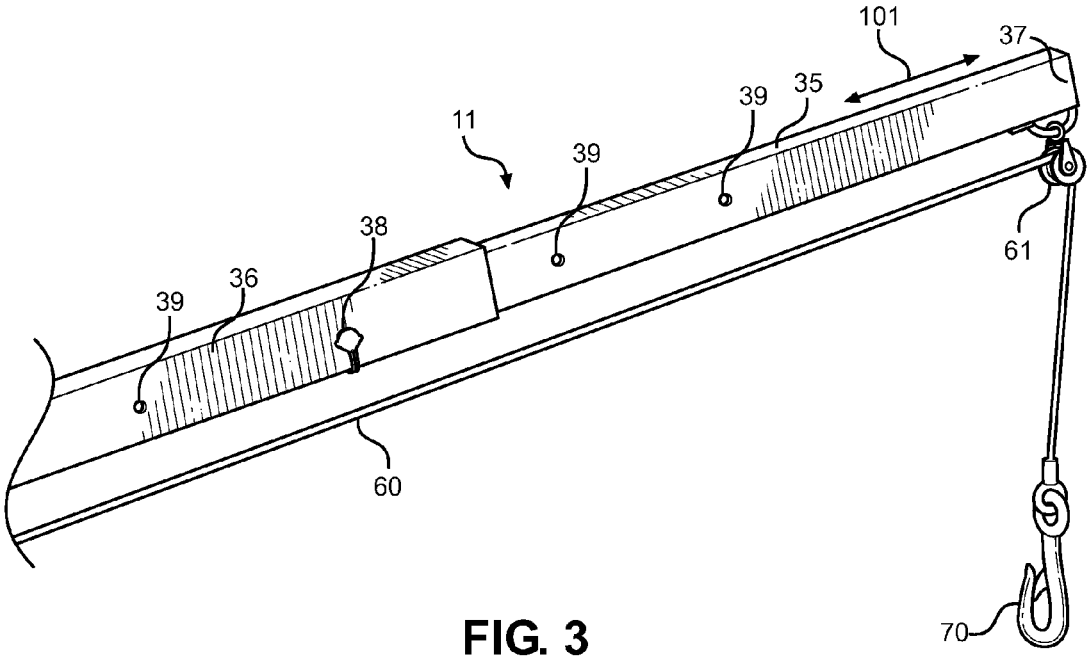
FIG. 3 shows a view of the telescoping lifting boom.

Referring now to FIG. 3, there is shown a view of the lifting boom 11 of the crane, where its telescoping segments 35 and 36 are shown. The outer segment 35 slides 101 within the interior of the inner segment 36, whereby the inner segment 36 is hollow and sized to accommodate the shape and dimensions of the outer segment 35. The secure the two members together while lifting, a pin lock 38 is provided, while slidably engages through both segments at given intervals. These intervals are defined by pin hole locations 39 that align with one another to allow the pin lock 38 to slide through both sides of both segments and lock the two in a static configuration. Along the underside length of the lifting boom 11 is the tensioned cable 60, while a pulley 61 located at the underside distal end of the boom 11 supports the cable as it transitions to a vertical, suspended position supporting the lifting hook 70.

Figure 4:
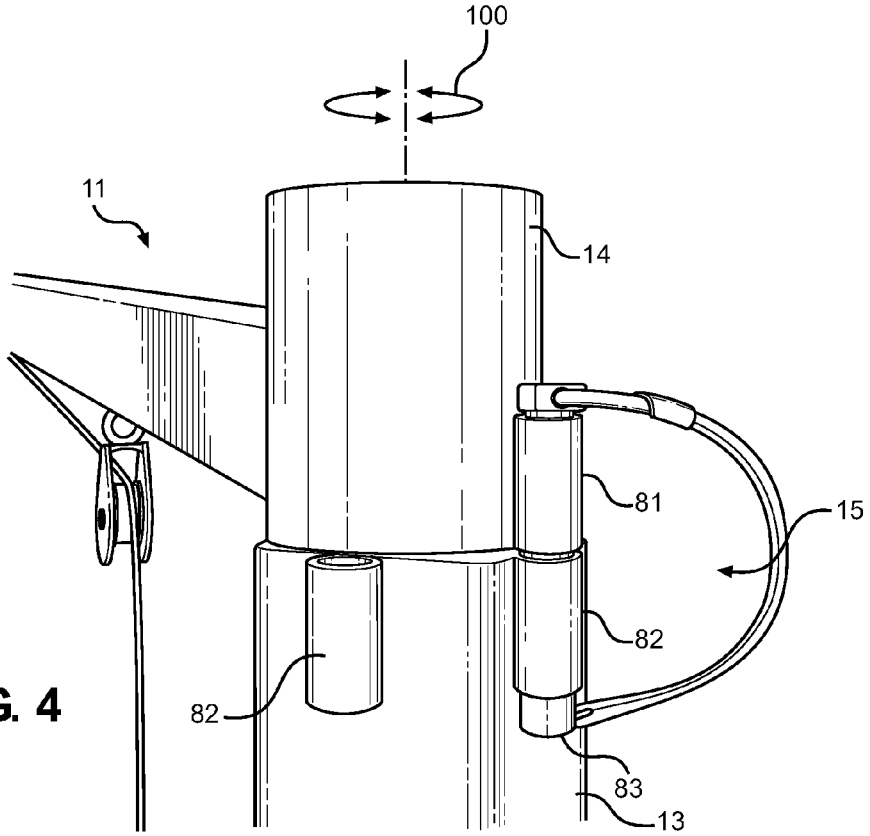
FIG. 4 shows a view of the lifting boom pivotable connection with the apparatus vertical post, along with a locking pin to secure the boom in place.

Referring now to FIG. 4, there is shown a close-up view of the connection between the lifting boom vertical member 14 and the upstanding post 13. This connection is a pivot joint that allows the boom 11 to be rotatable about the upstanding post 13 for positioning the lifting hook directly over the load to be lifted, without requiring the user to move the vehicle accordingly. The boom includes a vertical member 14 that is received by the open interior of the upstanding post 13, permitting free rotation thereof. The joint can further be locked into place by way of a pin lock joint 15. The pin lock joint 15 comprises aligned locking sleeves 81, 82 and a vertical pin lock member 83. Several locking sleeves 82 are provided along the upstanding post 13 perimeter, while a singular upper locking sleeve 81 allows for alignment thereof before fitting through the aligned sleeves the pin lock member 83. In another embodiment, the boom vertical member 14 may include several locking sleeves and the post may include a singular locking sleeve. The overall goal is to provide a means of locking the boom 11 rotation by way of aligned sleeves and a locking pin, whereby this can be accomplished in a number of discrete locations around the perimeter of the upstanding post 13.

Figure 5:
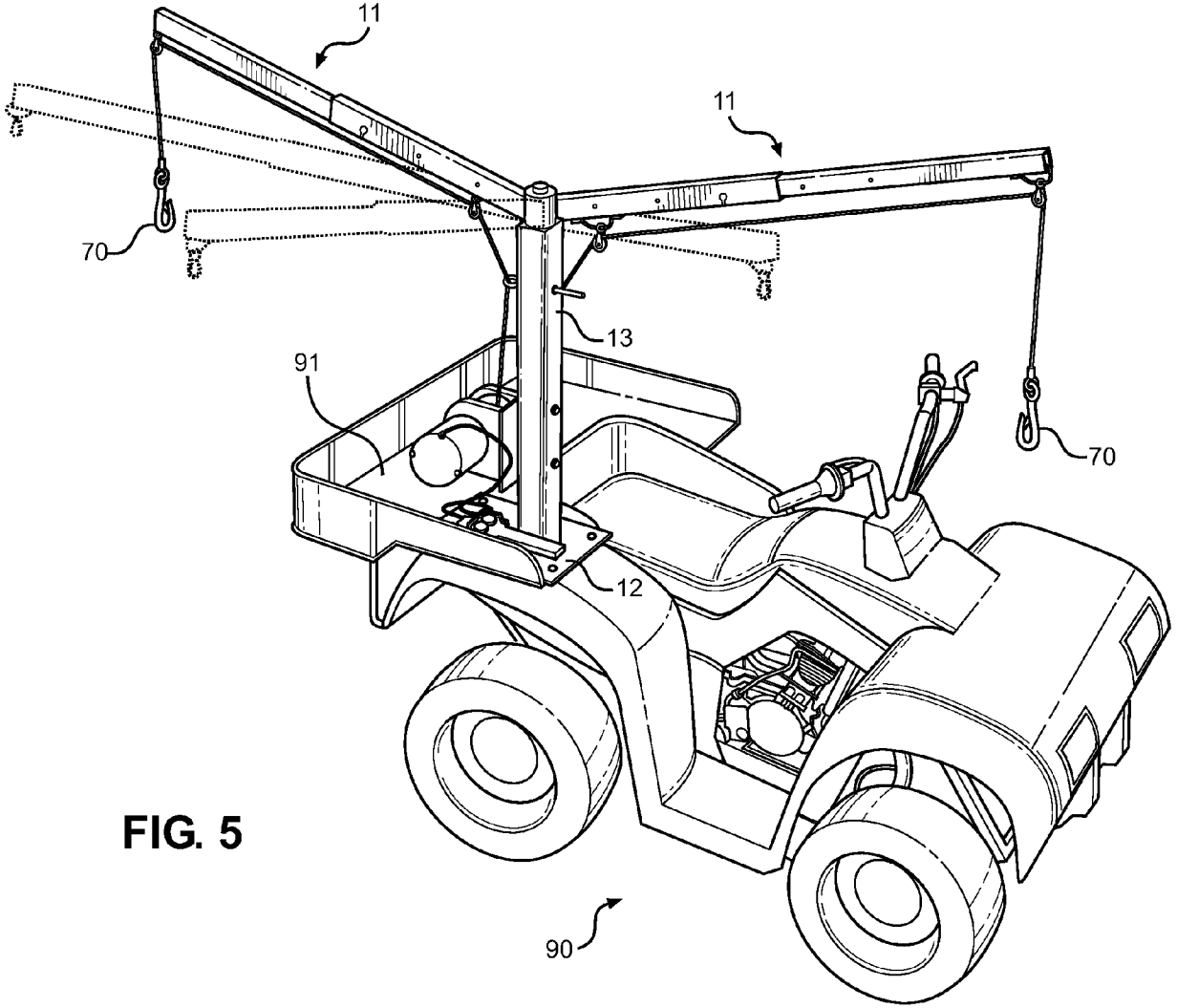
FIG. 5 shows an overhead view of the lifting crane apparatus attached to an ATV, wherein its pivotable construction is visualized.

Referring finally to FIG. 5, there is shown a view of the ATV lifting crane apparatus in connection to an ATV 90, where its pivotable nature is visualized. The ATV 90 includes a cargo area 91 that supports the base plate 12 of the apparatus. The base plate 12 is fastened thereto to secure the apparatus when lifting heaving loads into the cargo area 91. When an animal is to be lifted, the vehicle 90 can be parked adjacent or in front of the animal, whereafter the boom 11 is pivoted around the vehicle 90 to position the lifting hook 70 over the animal. The boom 11 can also be extended if the animal is farther away from the vehicle or its center of mass is positioned away from the vehicle. Once tethered to the lifting hook 70, the user can operate the hoist mechanism by hand or by electric motor to lift the animal off the ground. The suspended animal can then be positioned over the cargo area and lowered thereonto.

It can be difficult to load and haul heavy items in the back of an ATV. Many people require assistance from at least one other person. If someone is not available to help, they may try to load the ATV on their own. This can lead to serious back injuries, pulled muscles, and an overall achy body. In addition, gardeners, farmers or people working outdoors sometimes need to lift heavy equipment, but may not be physically able to due to age or a weak back.

The present invention provides an apparatus for an all-terrain vehicle that includes a lifting boom attached to the ATV cargo bed. The boom can be extended and rotated to position a lifting hook over a hunted animal or an article being moved. The apparatus thus enables a user to lift and load game or other materials onto the ATV cargo area through mechanical assistance. The apparatus eliminates the hassle and risk associated with bending over and lifting heavy items, thereby preventing hunters and other individuals from straining a muscle or hurting their back while out in the field. The device can also be used in a garden, backyard, farm, or any other outdoor setting, and is ideal for all ATV owners, especially the elderly or people with back problems who may not be able to lift heavy items.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lifting crane apparatus for attachment to a vehicle, comprising:

a base plate adapted to be connected to a vehicle cargo area;

an upstanding, hollow post extending from said base plate;

a lifting boom having a vertical portion and a telescoping arm portion;

said vertical portion of said lifting boom adapted to be received by said upstanding post and pivotably supported thereby;

said telescoping arm portion having an inner and outer member that slidably engage and lock together to change a length of said telescoping arm portion;

a hoist mechanism comprising a spool;

a cable extending from said spool and supported along said upstanding post and lifting boom by at least one pulley and at least one eyelet guide;

a lifting hook attached to a distal end of said cable;

a first pin locking mechanism to secure said telescoping arm portion to a static length;

a second pin locking mechanism to secure said lifting boom vertical portion to said upstanding post in a static relationship;

the second pin locking mechanism comprising a first sleeve member disposed on the hollow post and a second sleeve member disposed on the vertical portion of the lifting boom;

a removable pin member that is vertically inserted through the first sleeve member and the second sleeve member when the first sleeve member and the second sleeve member are aligned.

2. The device of claim 1, wherein said hoist mechanism comprises a hand crank.

3. The device of claim 1, wherein said hoist mechanism comprises an electric motor crank.

* * * * *